US006705061B1

(12) United States Patent
Porret et al.

(10) Patent No.: US 6,705,061 B1
(45) Date of Patent: Mar. 16, 2004

(54) METHOD FOR EXTERNAL DECONTAMINATION OF A PACKAGED OBJECT

(75) Inventors: Jean-Yves Porret, Gieres (FR); Jean-Pierre Grimard, Vif (FR)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 09/762,986

(22) PCT Filed: Jul. 2, 1999

(86) PCT No.: PCT/FR99/01779

§ 371 (c)(1),
(2), (4) Date: Feb. 15, 2001

(87) PCT Pub. No.: WO00/12388

PCT Pub. Date: Mar. 9, 2000

(30) Foreign Application Priority Data

Aug. 27, 1998 (FR) ..... 98 10928

(51) Int. Cl.[7] ..... B65B 55/02
(52) U.S. Cl. ..... 53/425; 53/426; 53/512
(58) Field of Search ..... 53/425, 426, 428, 53/434, 243, 453, 512

(56) References Cited

U.S. PATENT DOCUMENTS 4,467,588 A * 8/1984 Carveth ..... 53/425
4,813,210 A * 3/1989 Masuda et al. ..... 53/425
4,998,400 A * 3/1991 Suzuki et al. ..... 53/425
5,033,252 A * 7/1991 Carter ..... 53/425
5,997,811 A * 12/1999 Esposito ..... 53/425

* cited by examiner

*Primary Examiner*—Eugene Kim
*Assistant Examiner*—Sameh Tawfik
(74) *Attorney, Agent, or Firm*—Hoffman & Baron, LLP

(57) ABSTRACT

A process for the external decontamination of a packaged object, the latter comprising the object proper, at least the external surface of which is in the decontaminated state, for example sterile, a closed wrapper containing said object, the interior of which is in the decontaminated state, for example sterile, as well as a means of filtration, said process comprising a step of decontaminating the external surface of the wrapper, wherein, before the step of decontaminating the external surface of the wrapper:

a) at least two parts and are formed in the wrapper, these respectively determining two compartments and which are leaktight with respect to one another, a first part containing said object, and a second part comprising the whole of the filtration means;

b) the second part is separated from the first part, while preserving the leaktightness of the first compartment;

then the first part alone is subjected to the step of decontaminating the external surface of the wrapper.

8 Claims, 2 Drawing Sheets

METHOD FOR EXTERNAL DECONTAMINATION OF A PACKAGED OBJECT

FIELD OF THE INVENTION

The present invention relates to the external decontamination of a packaged object known per se, especially in the medical or pharmaceutical field.

BACKGROUND OF THE INVENTION

Generically, the packaged objects to which the decontamination process according to the invention relates, comprise:

- the object proper, at least the external surface of which is in the decontaminated state;
- a closed wrapper containing said object, the interior of which is in the decontaminated state;
- and a means of filtration providing for a gas flow through the wrapper, but the cutoff threshold of which is determined so as to prevent the flow of contaminating agents to the interior of the wrapper.

The terms "contamination" or "contaminated" are understood to mean any state on or in an object, not controlled or superintended, characterized by the presence of any undesired substance, biological or of biological origin, for example a pathogen, and/or of any nonbiological substance, for example in the discrete state or in the form of particles, liable to serve as a vector or carrier for said undesired biological substance.

As a consequence of the above definition, a contaminating agent according to the invention comprises a biological substance and/or a nonbiological substance, such as were defined above.

The terms "decontaminated" or "decontamination" are understood to mean any limited or controlled level of contamination on or in an object.

The terms "sterile" or "sterility" are understood to mean a level of decontamination characterized in particular by the statistical absence of any biological substance in or on an object.

More particularly, but in nonexclusive manner, the present invention will now be introduced, defined and described below, with reference to the medical or pharmaceutical field, wherein it is often obligatory to preclude or limit any contamination of biological origin originating from an exterior environment.

In this particular field, and referring to the industrial and commercial activity of the Applicant, the latter manufactures and sells packaged objects complying with the above generic definition, in that:

- the object proper consists for example of a closed or open container, in which is placed a charge consisting for example of a multiplicity of components for medical or pharmaceutical use, namely syringe bodies which are to be filled with a medicine which may take diverse forms, and especially liquid form; this container is completely decontaminated, as regards the external surface, the internal surface, the interior of said container, or else the aforementioned charge; however, the object proper, to which the present invention relates, can also consist of a single product for medical or pharmaceutical use;
- the wrapper consists of a pouch closed for example by welding, the wall of which consists of a material such as a flexible thermoplastic; the interior of this pouch is in the decontaminated state, whilst the external surface of the same pouch remains contaminated, that is to say non-sterile;
- the filtration means consists for example of an item of a material chosen in particular from among a thermoplastic in the nonwoven state, a coated paper, a woven material exhibiting micro-perforations; this item is fixed to the material of the pouch or wrapper, for example by heat-welding, sealing, adhesive bonding; it is this means of filtration which allows the packaged object to "breathe", in that it for any gas flow to the interior or the exterior of the wrapper, for example to carry out decontamination, and inside the wrapper, outside the object proper, or even inside the latter, in the case of a container which is itself provided with its own means of filtration; by way of example, the means of filtration is an item made from a material known as "TYVEK®", and sold by the company DUPONT de NEMOURS; the internal face of the above-defined filtration means also remains in the decontaminated state.

The above-exemplified packaged object serves in practice to feed the aforesaid components for medical or pharmaceutical use, for example syringe bodies, from an exterior environment toward and into an enclosure with controlled atmosphere, in which said components are unpacked and used or consumed, for example to mass-produce syringes prefilled with a medicine.

To this end, it is necessary to carry out prior external decontamination of the packaged object. Conventionally, this may be done for example by passing the packaged object through an airlock or decontamination tunnel in which the external surface of the wrapper is exposed to a decontaminating treatment, for example illuminated with a sterilizing radiation, such as ultraviolet light.

Such a decontamination process is rather imperfect for all kinds of reasons, pertaining essentially to the existence on the packaged object of the above-exemplified means of filtration:

- since the means of filtration consists of an added item fixed to the material of the wrapper proper, the seals thus obtained themselves constitute "nests" of contamination, which are especially difficult to treat by illumination with a decontaminating radiation, for example ultraviolet;
- the means of filtration anyway constitutes an opaque part, whose cast shadow on the remainder of the wrapper hinders or impairs the decontamination of the corresponding part of said wrapper;
- the means of filtration retains the contaminating agents (for example bacteria) in situ; and complete decontamination of said means of filtration cannot be ensured.

The present invention aims to remedy all these drawbacks.

The subject of the invention is a process for the external decontamination of a packaged object, remaining compatible with the employment of a means of filtration on the closed wrapper, but making it possible to circumvent the latter during the external decontamination of the wrapper.

According to the invention, before the step of decontaminating the external surface of said wrapper:

a) at least two parts are formed in said wrapper, these respectively determining two compartments which are leaktight with respect to one another, a first part containing said object, and a second part comprising the whole of the filtration means;

b) the second part is separated from the first part of the wrapper while preserving the leaktightness of the first compartment;

then the first part alone is subjected to the step of decontaminating the external surface of the wrapper.

Consequently, according to the invention, the packaged object is brought into a characteristic intermediate conformation, according to which the wrapper is formed of at least two parts respectively determining two compartments which are leaktight with respect to one another, namely a first part containing the object proper, and a second part comprising the whole of the filtration means.

The process according to the invention moreover affords an unexpected advantage when the step of decontaminating the external surface of the wrapper is performed, no longer by illuminating the packaged object with a decontaminating radiation, but comprises a sterilization by placing the external surface in contact with a sterilizing gaseous medium, especially a sterilizing gas, for example ethylene oxide. Thus, unlike the case of a packaged object treated for example in the conventional manner, the gaseous medium exerts its sterilizing action solely on the external surface of the wrapper, limited to the first above-defined part, that is to say without the means of filtration; in this way, the gaseous medium does not penetrate inside the flexible wrapper, and possibly inside the object proper, thereby limiting the consumption of sterilizing gas on the one hand and limiting the treatment time on the other hand, since in particular it is no longer necessary to evacuate the interior of the flexible pouch and possibly of the object proper. This also makes it possible to preclude the presence of any residual sterilizing gas within the wrapper and possibly the object.

Moreover, again unexpectedly, the intermediate conformation of the packaged object, which characterizes the invention, can be employed for another purpose entirely, namely to obtain the same object in packed form, but incorporating a pre-unpacking indicator of integrity. For this purpose, starting from the packaged object as defined above:

a) the gas contained in the wrapper is evacuated from the interior of the latter, or the interior of said wrapper is filled with the inert gas, especially in the decontaminated state;

b) then at least two parts are formed in the wrapper, these respectively determining two compartments which are leaktight with respect to one another, a first part containing said object, and a second part comprising the whole of the filtration means;

c) the second part is separated from the first part, while preserving the leaktightness of the first compartment; by means of which the first part of the wrapper, evacuated or filled, indicates the integrity of the packing of the packaged object.

BRIEF DESCRIPTION OF THE DRAWINGS

The present invention is now described by way of example with reference to the appended drawing, in which.

DESCRIPTION OF THE PREFERRED EMBODIMENTS(S)

Figure 1:
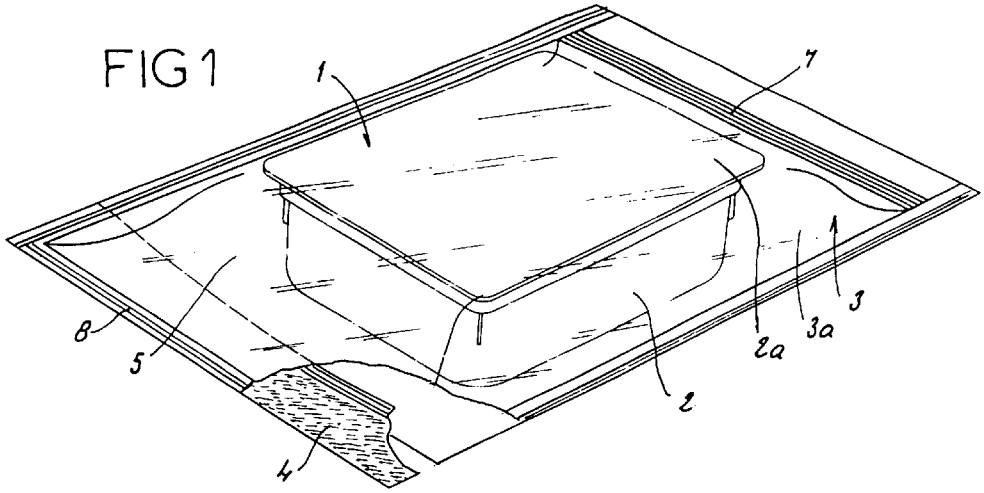
FIG. 1 represents, in perspective, a packaged object before employing the decontamination process according to the invention.

A packaged object 1, such as treated according to the process of the invention, comprises:

the object 2 proper, at least the external surface 2*a* of which is in the decontaminated state;

a closed wrapper 3, containing the object 2, the interior of which is in the decontaminated state; this wrapper can be obtained from a sheath, or from two flanks of a flexible thermoplastic, welded for example by melting, high-frequency fusion, ultrasonic fusion of said thermoplastic, along a weld line which determines in particular two parallel and extreme seals 7 and 8;

a means of filtration 4 providing for a gaseous flow through the wrapper 2, the cutoff threshold of which is determined so as to prevent the flow of contaminating agents to the interior of the wrapper; as stated above, this is for example an item supplementing the wrapper 2, which is added and fixed to one and/or both flanks of said wrapper; by way of example, the filtration means 4 is an item of a nonwoven cloth of a thermoplastic, which is added to one of the flanks of the wrapper and heat-welded on one side to the lower flank (cf. FIG. 1), and on the other side to the upper flank along the line 8, as well as along its transverse edges.

Figure 2:
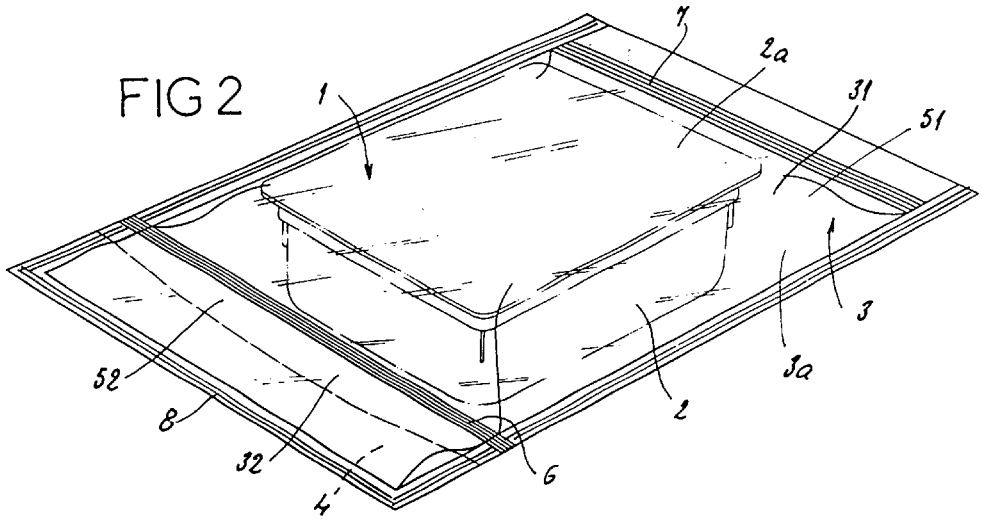
FIG. 2 represents a perspective view of the same object in its intermediate conformation, again in the course of the decontamination process according to the invention.
Figure 3:
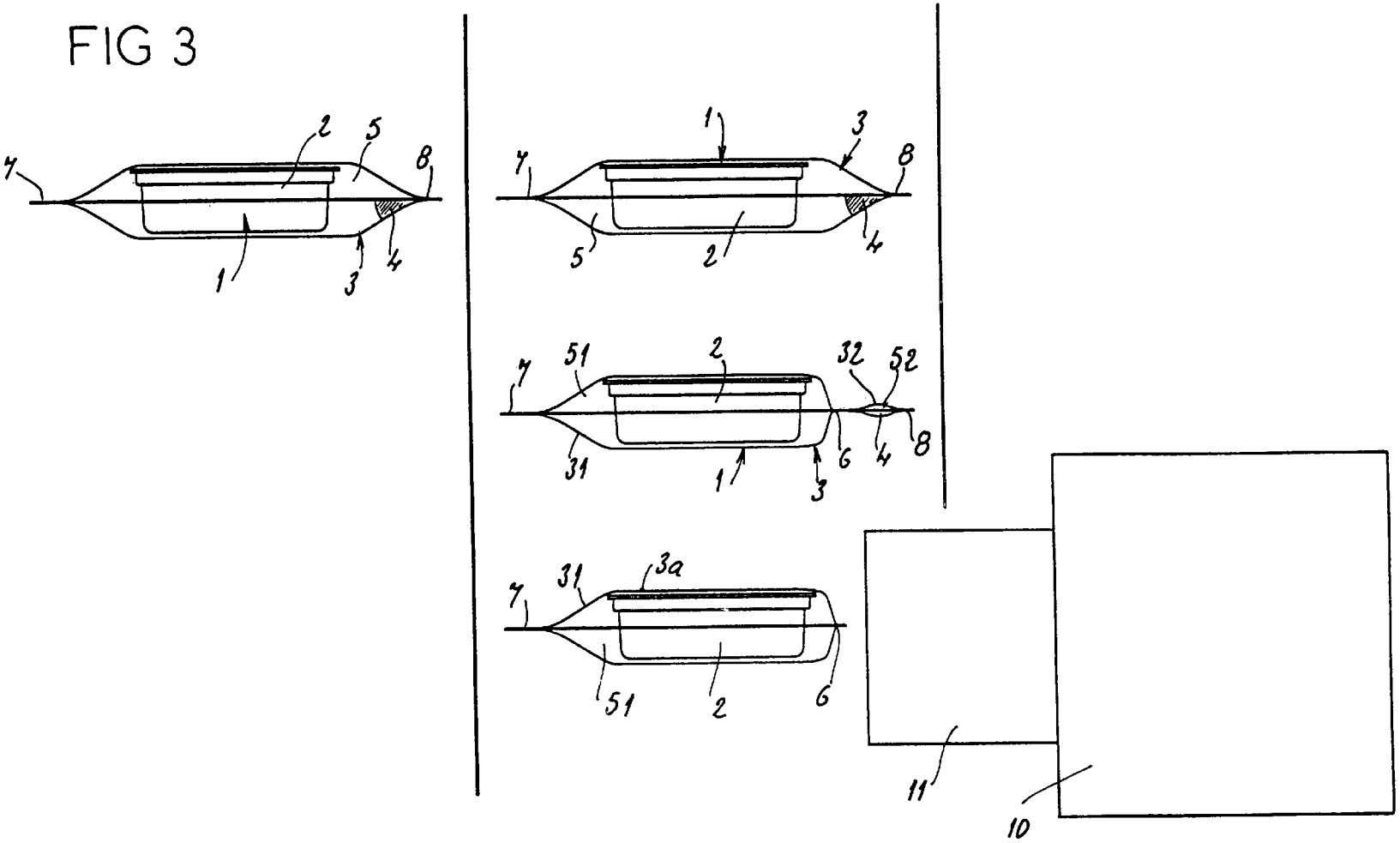
FIG. 3 represents, diagrammatically, the various steps of the decontamination process according to the invention, starting from a packaged object as represented in FIG. 2.

The above-defined packaged object is represented on the left of FIG. 3, before employing the process according to the invention, which comprises the following steps:

a) at least two parts 31 and 32 are formed in the wrapper 3, these respectively determining two compartments 51 and 52 which are leaktight with respect to one another, a first part 31 containing the object 2, and a second part 32 containing the whole of the filtration means 4; an intermediate conformation represented in FIG. 2, and diagrammatically in FIG. 3 at the center of the latter, is thus obtained; in practice, the separating of the first part 31 is achieved by forming at least one, or even two weld lines 6 by melting the thermoplastic, and then cutting; this same separating can be achieved by techniques other than heat-welding, for example sealing or adhesive bonding;

b) it is only the first part 31 of the wrapper 3 containing the object 2 but not the means of filtration 4, which is leaktight with respect to the exterior environment which is subjected to the step for decontaminating the external surface 3*a* of the wrapper 3, in the decontamination tunnel 11 leading to an enclosure 10 with controlled atmosphere, in which the object 2 is unpacked.

Figure 4:
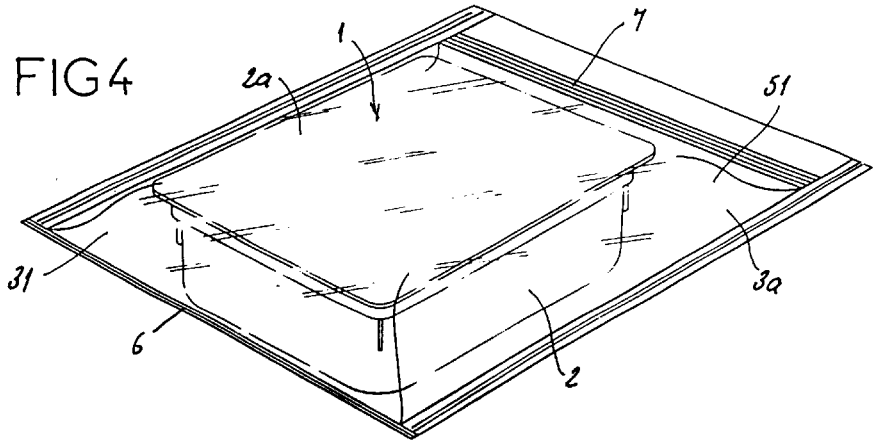
FIG. 4 represents the packaged object in its conformation immediately before the decontamination step.

The packed object resulting from steps (a) and (b) is more particularly represented in FIG. 4 or in the central part and at the bottom of FIG. 3.

What is claimed is:

1. A process for the external decontamination of a packaged object having an external surface in a decontaminated state, the packaged object being contained in a closed wrapper having an interior in a decontaminated state and that includes a filtration means for providing for a gas flow through the closed wrapper, the filtration means having a cutoff threshold that is determined so as to prevent the flow of contaminating agents to the interior of the closed wrapper, said process comprising the steps of:

a) forming two parts in the closed wrapper by defining a boundary between said parts, said boundary being formed by one of the methods selected from a group consisting of heat-welding, sealing and adhesive bonding, the two parts respectively determining two compartments which are leaktight with respect to one another, a first compartment containing the packaged object, and a second compartment comprising the whole of the filtration means;

b) separating the second part from the first part, while preserving the leaktightness of the first part; and c) decontaminating an external surface of the first part alone.

2. The process as claimed in claim 1, wherein the wrapper consists of a flexible thermoplastic and the two parts in the wrapper are formed by melting the thermoplastic along a weld line determining the two parts and the two compartments.

3. The process as claimed in claim 1, wherein the step of decontaminating the external surface comprises illuminating the packaged object with a decontaminating radiation.

4. The process as claimed in claim 1, wherein the step of decontaminating the external surface comprises a sterilization step performed by placing the external surface in contact with a sterilizing gaseous medium.

5. The process as claimed in claim 4, wherein the sterilizing gaseous medium is ethylene oxide.

6. A packaged object comprising:

the object proper having an external surface that is in a decontaminated state;

a closed wrapper containing the object, the closed wrapper having an interior that is in the decontaminated state, the closed wrapper having a filtration means for providing for a gas flow through the closed wrapper, the filtration means having a cutoff threshold that is determined so as to prevent the flow of contaminating agents to the interior of the closed wrapper, wherein the wrapper is formed of two parts separated by a boundary, said boundary being selected from a group consisting of one or more weld lines, seals and adhesive bonds, said parts respectively determining two compartments which are leaktight with respect to one another, namely a first part containing the object, and a second part comprising the whole of the filtration means, and wherein the second part is separable from the first part to permit decontamination of an external surface of the first part alone.

7. The object as claimed in claim 6, wherein the closed wrapper consists of a flexible thermoplastic, and wherein the two parts in the wrapper are formed by a weld line formed by melting the thermoplastic so as to determine the two parts and the two compartments.

8. The object as claimed in claims 7, wherein the filtration means consists of an item of a material chosen from among a thermoplastic in the nonwoven state, a coated paper, a woven material exhibiting micro-perforations, which item is fixed to the thermoplastic of the wrapper.

* * * * *